US011623718B2

(12) United States Patent
Koontz, IV et al.

(10) Patent No.: US 11,623,718 B2
(45) Date of Patent: Apr. 11, 2023

(54) BEANBAG WITH STORAGE

(71) Applicants: Alfred Joseph Koontz, IV, Vero Beach, FL (US); Alfred Joseph Koontz, III, Vero Beach, FL (US); Kimberly McGee Koontz, Vero Beach, FL (US); John Griffin Koontz, Vero Beach, FL (US); Reilly Christine Koontz, Vero Beach, FL (US)

(72) Inventors: Alfred Joseph Koontz, IV, Vero Beach, FL (US); Alfred Joseph Koontz, III, Vero Beach, FL (US); Kimberly McGee Koontz, Vero Beach, FL (US); John Griffin Koontz, Vero Beach, FL (US); Reilly Christine Koontz, Vero Beach, FL (US)

( * ) Notice: Subject to any disclaimer, the term of this patent is extended or adjusted under 35 U.S.C. 154(b) by 174 days.

(21) Appl. No.: 17/374,712

(22) Filed: Jul. 13, 2021

(65) Prior Publication Data

US 2023/0019548 A1 Jan. 19, 2023

(51) Int. Cl.

| | |
|---|---|
| ***B63C 9/28*** | (2006.01) |
| ***A47C 27/08*** | (2006.01) |
| ***A47C 1/14*** | (2006.01) |
| ***A47C 3/16*** | (2006.01) |
| ***A47C 7/62*** | (2006.01) |

(52) U.S. Cl.

CPC ..... *B63C 9/28* (2013.01); *A47C 1/146* (2013.01); *A47C 3/16* (2013.01); *A47C 7/622* (2018.08); *A47C 27/086* (2013.01)

(58) Field of Classification Search

None

See application file for complete search history.

(56) References Cited

U.S. PATENT DOCUMENTS

| | | | | |
|---|---|---|---|---|
| 4,011,611 A * | 3/1977 | Lederman | A47C 15/006 | 5/655.4 |
| 4,281,873 A * | 8/1981 | Holland | A47C 27/086 | 297/118 |
| 6,045,178 A * | 4/2000 | Miller | A47C 27/086 | 5/655.4 |
| 7,513,001 B1 * | 4/2009 | Leach | A47G 9/1045 | 5/655 |

(Continued)

FOREIGN PATENT DOCUMENTS

AU 5228279 A * 5/1981

*Primary Examiner* — David E Allred

(74) *Attorney, Agent, or Firm* — Alexander Postnikov

(57) ABSTRACT

A beanbag comprising a first layer, forming a generally closed container, a layer of cushioning lining an inside of the first layer, a cavity within the closed container, and a resealable access port to access the cavity. In a preferred embodiment, the first layer is marine vinyl, the cushioning is a uniform layer of marine foam, and the resealable access port is a marine-grade zipper. In another embodiment, the cushioning is a layer of beanbag beans. In another embodiment, the resealable access port is an opening at the end of a protrusion, wherein the protrusion can be rolled-up and secured with a fastening mechanism. The beanbag is intended for, but not limited to, use outdoors, such as on the beach, the decks of boats, patios, pool sides, and in water. In a preferred embodiment, the beanbag floats on water and further comprises a reflective band and reflective elements.

19 Claims, 5 Drawing Sheets

(56) References Cited

U.S. PATENT DOCUMENTS

| | | | | |
|---|---|---|---|---|
| 8,321,977 | B1 * | 12/2012 | Kummerfeld | A47D 13/083<br>5/636 |
| 9,433,301 | B2 * | 9/2016 | Brechet | A47C 4/54 |
| 11,432,660 | B1 * | 9/2022 | Lacy | A47C 15/006 |
| 2003/0151295 | A1 * | 8/2003 | Nelson | A47C 3/16<br>297/452.17 |
| 2005/0012364 | A1 * | 1/2005 | Ariizumi | A63H 3/02<br>297/181 |
| 2005/0138734 | A1 * | 6/2005 | George | A47C 3/16<br>5/652 |
| 2005/0150050 | A1 * | 7/2005 | Wolf | A47C 7/383<br>5/636 |
| 2013/0025527 | A1 * | 1/2013 | Cooney | B63B 17/04<br>114/65 R |
| 2013/0026801 | A1 * | 1/2013 | Goldman | A47C 7/02<br>297/188.09 |
| 2015/0028649 | A1 * | 1/2015 | George, II | A47C 27/087<br>297/452.17 |
| 2015/0035324 | A1 * | 2/2015 | George, II | A47C 27/086<br>297/188.01 |
| 2015/0250328 | A1 * | 9/2015 | Brechet | A47C 3/16<br>137/15.01 |
| 2019/0389628 | A1 * | 12/2019 | You | A47G 9/062 |
| 2021/0315336 | A1 * | 10/2021 | Fazackerley | A45C 7/0068 |
| 2022/0007839 | A1 * | 1/2022 | Matlin | A47C 15/006 |

* cited by examiner

BEANBAG WITH STORAGE

FIELD OF INVENTION

The present disclosure relates generally to the field of furniture with storage space, and, in particular, to the field of adjustable cushioned furniture specifically adapted to store equipment.

DESCRIPTION OF PRIOR ART

Seafaring vessels often have limited storage space, creating the need for unique storage solutions. One answer is to use multipurpose furniture that acts as both seating and storage. For example, benches that hold life vests are found on many boat decks. Although such arrangements provide basic storage, they come with many drawbacks to comfort and versatility. Benches are rigid and heavy, making them difficult to move and limiting their placement options. Furthermore, most benches have back support that is fixed in place or no back support at all. We need furniture that is lightweight, flexible, and provides full body comfort. Furthermore, said furniture may be waterproof and should store exactly as much as required.

SUMMARY

The present disclosure satisfies the foregoing needs by providing, inter alia, a beanbag for addressing each of the foregoing desirable traits as well as methods of its manufacture and methods of its use.

One aspect of the present disclosure is directed at a beanbag comprising an outer layer forming a generally closed container, a layer of cushioning lining the inside of said outer layer, an inside cavity, and a resealable access port to access said cavity. The cushioning may be a uniform foam layer or a layer of beanbag beans. The resealable access port may be a zipper or a hook and loop fastener. The outside layer may be waterproof or water-resistant.

This beanbag can be used for storage by inserting equipment into the cavity through the resealable access port. Small to medium sized equipment such as life-vests, towels, blankets, and soft toys can be stored in any position within the beanbag. The beanbag always provides exactly as much storage as required, expanding or shrinking when equipment is added or removed. Furthermore, the walls of the beanbag are soft, keeping any stored equipment safe. The walls may also be waterproof, keeping any stored equipment dry.

This beanbag has flexible walls that can be molded into a comfortable shape. Stored equipment can be rearranged within the beanbag, providing extra support in desired areas. Furthermore, the cushioning smooths out any bumps or irregularities caused by protruding sections of the equipment. This combination of elements provides a very versatile and comfortable piece of furniture.

Another aspect of the present disclosure is directed at a beanbag comprising an outer layer forming a generally closed container, a layer of cushioning lining the inside of said outer layer, an inside cavity, a protrusion, a fastening mechanism, and a resealable access port to access said cavity.

The protrusion terminates with said resealable access port. Said resealable access port can be sealed by pinching together a portion of said protrusion surrounding said resealable access port, rolling up said portion, and using a fastening mechanism to secure said beanbag in a rolled-up configuration.

BRIEF SUMMARY OF DRAWINGS

The foregoing summary, as well as the following detailed description of preferred embodiments of the invention, will be better understood when read in conjunction with the appended drawings. For the purpose of illustrating the invention, there is shown in the drawings embodiments that are presently preferred. It should be understood, however, that the invention is not limited to the precise arrangements and instrumentalities shown. In the drawings, where.

DETAILED DESCRIPTION

The terminology used herein is for the purpose of describing particular embodiments only and is not intended to be limiting of the invention. As used herein, the terms "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning in the context of relevant art and the present disclosure will not be interpreted in an idealized or overly formal sense unless expressly so defined herein.

In describing the invention, it will be understood that a number of elements and techniques are disclosed. Each of these has individual benefit, and each can also be used in conjunction with one or more, or in some cases all, of the other disclosed elements and techniques. Accordingly, for the sake of clarity, this description will refrain from repeating every possible combination of the individual elements or techniques in an unnecessary fashion. Nevertheless, the specification and claims should be read with the understanding that such combinations are entirely within the scope of the invention and the claim.

Figure 1A:
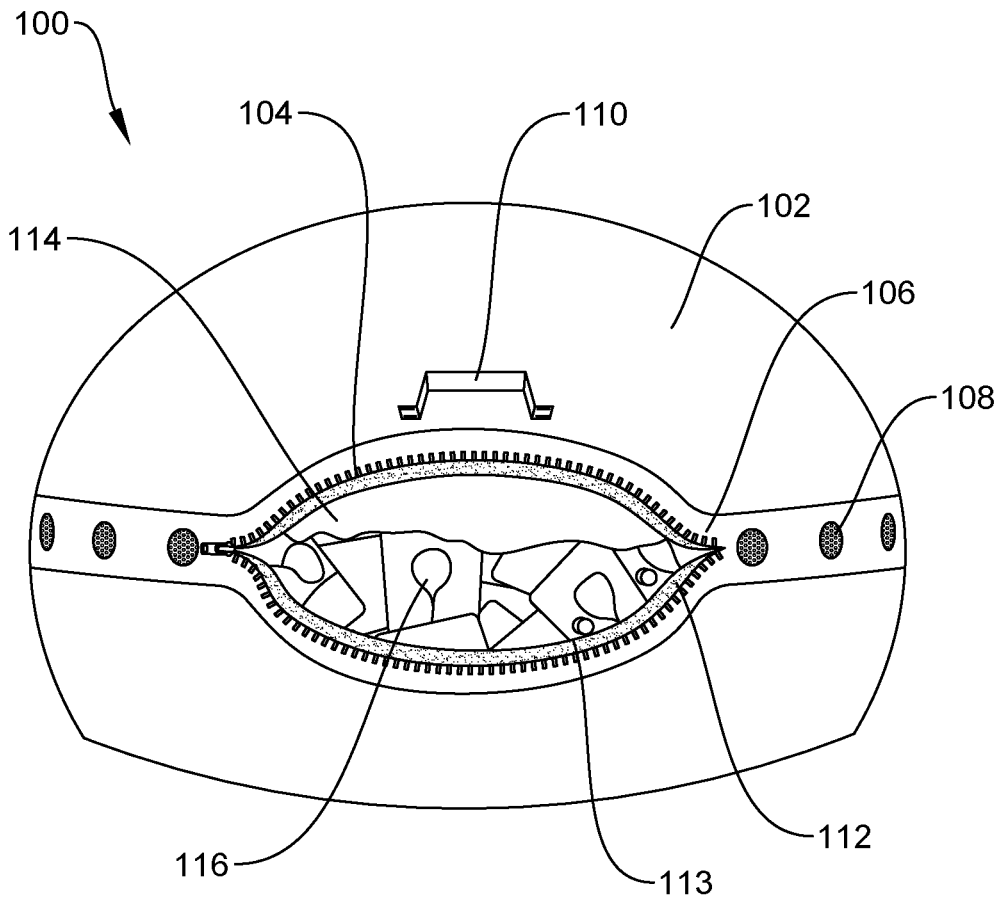
FIG. 1A-FIG. 1A is a front view of one embodiment of the present invention in its open configuration.

Now referring to FIG. 1A, one exemplary beanbag 100 is illustrated and described in detail. The beanbag 100 may comprise a first layer 102, a resealable access port 104, a reflective band 106, a plurality of reflectors 108, at least one handle 110, cushioning 112, a second layer 113, and a cavity 114. The layers of the beanbag 100 form the wall of the beanbag 100, wherein the wall is comprised of the first layer 102, the cushioning 112, the second layer 113, and, in some areas, the reflective band 106. In another embodiment, the wall is comprised of only the first layer 102, the cushioning 112, and, in some areas, the reflective band 106. In yet another embodiment, the wall is comprised of only the first layer 102 and the cushioning 112.

The first layer 102 forms a generally closed container and may be marine vinyl. In another embodiment, the first layer 102 may be a breathable mesh. In yet other embodiments, the first layer 102 may be any flexible material or fabric. In yet other embodiments, the first player 102 may be waterproof or water-resistant. The first layer 102 may be colored or patterned to highlight the life preserving nature of the beanbag 100 in emergency situations.

The resealable access port 104 may be embedded, using adhesives, stitching, or the like, within the wall of the beanbag 100 and may be generally linear in shape. In other embodiments, the resealable access port 104 may be curved, circular, or any other shape that does not inhibit the functionality of the beanbag 100. The resealable access port 104 may be a marine grade zipper. In another embodiment, the resealable access port 104 may be a hook and loop fastener. In yet other embodiments, the resealable access port 104 may be any fastening mechanism that creates a seal. The beanbag 100 is in its open configuration when the resealable access port 104 is open and the sides of the resealable access port 104 are pulled apart to create an opening in the wall of the beanbag 100, wherein the opening is sufficiently large to permit the passage of small to medium sized equipment 116 such as a life-vest.

The reflective band 106 may be attached, using adhesives, stitching, or the like, to the outer surface of the first layer 102 and may encircle the beanbag 100. The reflective band 106 may have light-reflecting properties. In another embodiment, there may be more than one reflective band 106 as part of the beanbag 100. In yet other embodiments, the beanbag 100 may be covered in reflective elements that are not band shaped.

The reflectors 108 may be attached, using adhesives, stitching, or the like, to the outer surface of the reflective band 106. There may be a plurality of reflectors spaced equidistant along the center line of the reflective band 106. The reflectors 108 may have light-reflecting properties. In another embodiment, the reflectors 108 may be attached, using adhesives, stitching, or the like, directly to the outer surface of the first layer 102.

The handle 110 may be attached, using adhesives, stitching, or the like, to the outer surface of the first layer 102. In another embodiment, there may be three handles 110 as part of the beanbag 100. In yet other embodiments, there may be between 1-10 handles 110 as part of the beanbag 100.

The cushioning 112 may be a uniform layer of marine foam lining the inside of the first layer 102 and may have a thickness of 0.5-5 inches, preferably 1-3 inches, and most preferably 2 inches. In another embodiment, the cushioning 112 may be memory foam. In yet another embodiment, the cushioning 112 may be any foam with a density lower than 1 g/cm$^3$. In yet another embodiment, the cushioning may be a non-uniform layer of beanbag beans. The beanbag beans may be polystyrene beans, polystyrene balls, foam bits, or any other resilient flowable pellets having a specific gravity of less than unity. The beanbag beans may constitute 0-30% of the maximum interior volume of the beanbag 100, preferably 5-25% of the maximum interior volume of the beanbag 100, and most preferably 10-20% of the maximum interior volume of the beanbag 100. The cushioning smooths out any bumps or irregularities caused by protruding sections of the equipment 116 within the beanbag 100.

The second layer 113 may be attached, through adhesives, stitching, or the like, to the inside surface of the cushioning 112 and may be marine vinyl. In another embodiment, the second layer 113 may be a breathable mesh. In yet another embodiment, the second layer 113 may be any flexible material or fabric. In yet other embodiments, the second layer is waterproof or water resistant. In yet other embodiments, the beanbag 100 does not comprise a second layer 113.

The cavity 114 may be within the inner surface of the second layer 113 or the inner surface of the cushioning 112. The cavity 114 may be accessed by a user when the resealable access port 104 is open and the sides of the resealable access port 104 are pulled apart to create an opening in the wall of the beanbag 100.

Equipment 116 may be stored in the cavity 114. The equipment 116 may comprise life-saving equipment such as life jackets, life preservers, visual distress signaling devices, and sound producing devices positioned in any configuration within the cavity 114. The equipment 116 may further comprise lifestyle items such as towels, pillows, blankets, and soft toys positioned in any configuration within the cavity 114.

Figure 1B:
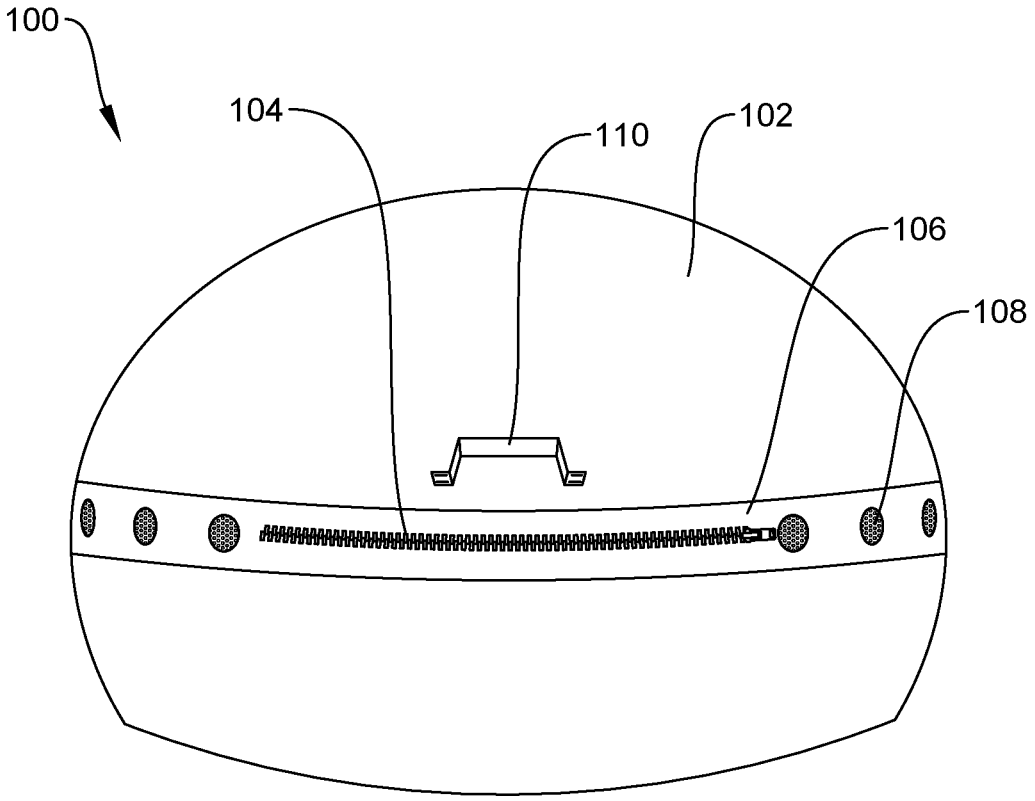
FIG. 1B-FIG. 1B is a front view of one embodiment of the present invention in its closed configuration.

Now referring to FIG. 1B, the beanbag 100, in its closed configuration, is illustrated. The beanbag 100 is in its closed configuration when the resealable access port 104 is closed, fully sealing the wall of the beanbag 100.

Figure 2A:
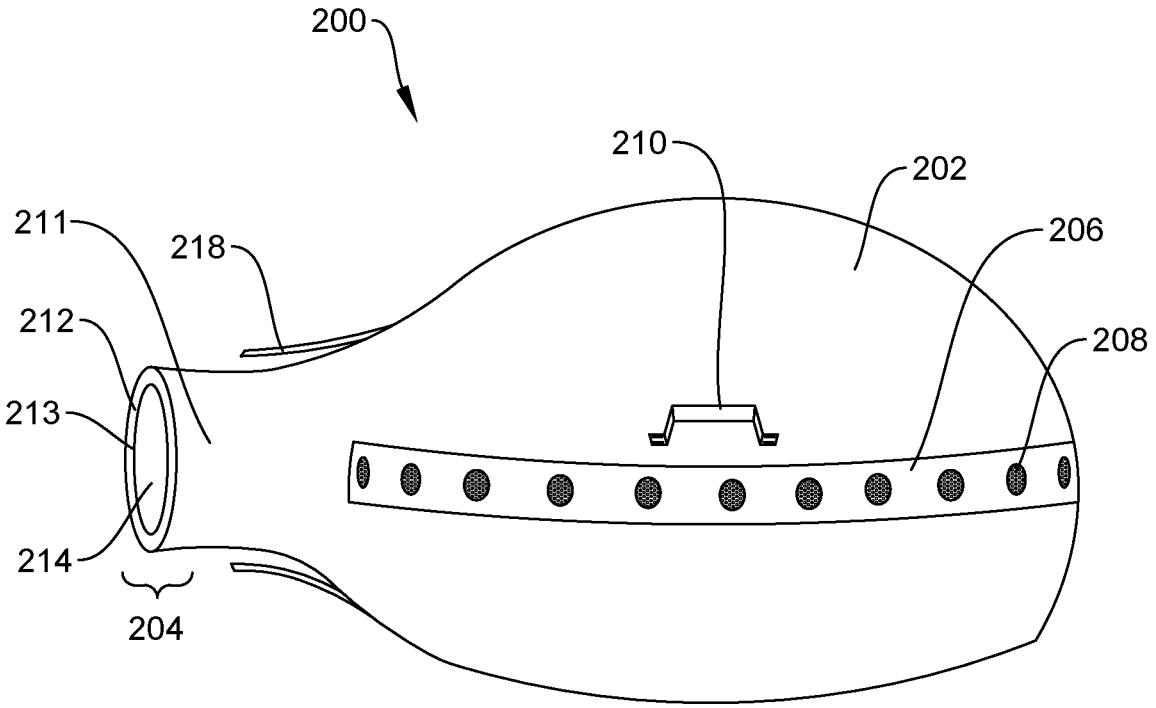
FIG. 2A-FIG. 2A is a front view of a second embodiment of the present invention in its open configuration.

Now referring to FIG. 2A, one exemplary beanbag 200 is illustrated and described in detail. The beanbag 200 may comprise a first layer 202, a reflective band 206, a plurality of reflectors 208, at least one handle 210, a protrusion 211, cushioning 212, a second layer 213, a cavity 214, and a fastening mechanism 218. The first layer 202, reflective band 206, reflectors 208, handle 210, cushioning 212, second layer 213, and cavity 214 are similar to the previously described first layer 102, reflective band 106, reflectors 108, handle 110, cushioning 112, second layer 113, and cavity 114 as illustrated in FIG. 1A and FIG. 1B.

The protrusion 211 may be an extended circular portion of the wall of the beanbag 200 that extends outward away from the outer surface of the first layer 202. In other embodiments, the protrusion 211 may be an extended portion of other shapes including, but not limited to, rectangles, ellipticals, ovals, and squares. The protrusion 211 may terminate with a resealable access port 204. The beanbag 200 is in its open configuration when the resealable access port 204 is open and the sides of the resealable access port 204 are pulled apart to create an opening in wall of the beanbag 200, wherein the opening is sufficiently large to permit the passage of small to medium sized equipment such as a life-vest. The opening may have the same shape as the resealable access port 204.

Equipment may be stored in the cavity 214. The equipment may comprise life-saving equipment such as life jackets, life preservers, visual distress signaling devices, and sound producing devices positioned in any configuration within the cavity 214. The equipment may further comprise lifestyle items such as towels, pillows, blankets, and soft toys positioned in any configuration within the cavity 214.

The fastening mechanism 218 may comprise a first strap and a second strap, wherein each strap has a first end and a second end, wherein the first end of each strap is attached, through adhesives, stitching, or the like, to the outer surface of the first layer 202 at the base of the protrusion 211, wherein the second end of each strap comprises a fastening element, and wherein the fastening elements of the first and second straps connect to each other to form a single secure strap. While two straps, a first strap and a second strap, is preferred, the beanbag 200 may nonetheless comprise more than two straps. The fastening elements of first and second straps may be corresponding parts of a hook and loop fastener. In another embodiment, the fastening elements of the first and second straps may be corresponding parts of a buckle. In yet other embodiments, the fastening elements of first and second straps may be corresponding parts of any fastening mechanism that connect to each other to form a secure strap or straps.

Figure 2B:
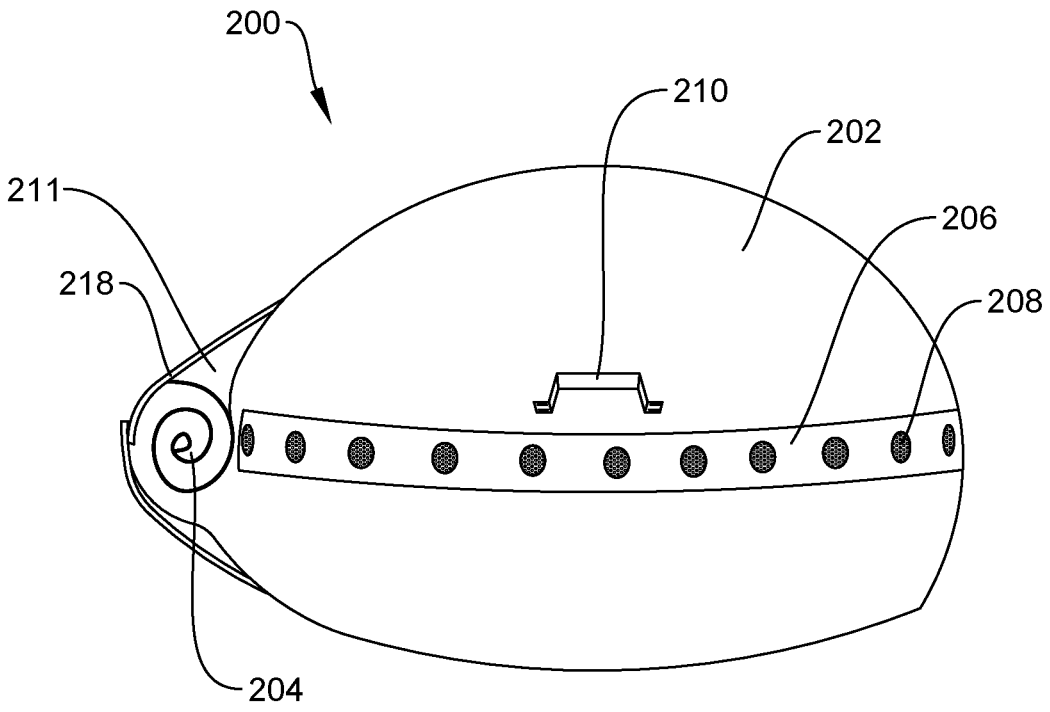
FIG. 2B-FIG. 2B is a front view of a second embodiment of the present invention in its closed configuration.

Now referring to FIG. 2B, the beanbag 200, in its closed configuration, is illustrated and described in detail. The beanbag 200 may be placed into a closed configuration by pinching together a portion of the protrusion 211 surrounding the resealable access port, rolling up the portion up to the base of the protrusion 211, and using the fastening mechanism 218 to secure the beanbag 200 in a rolled-up configuration by preventing the rolled up portion from unrolling.

Figure 3:
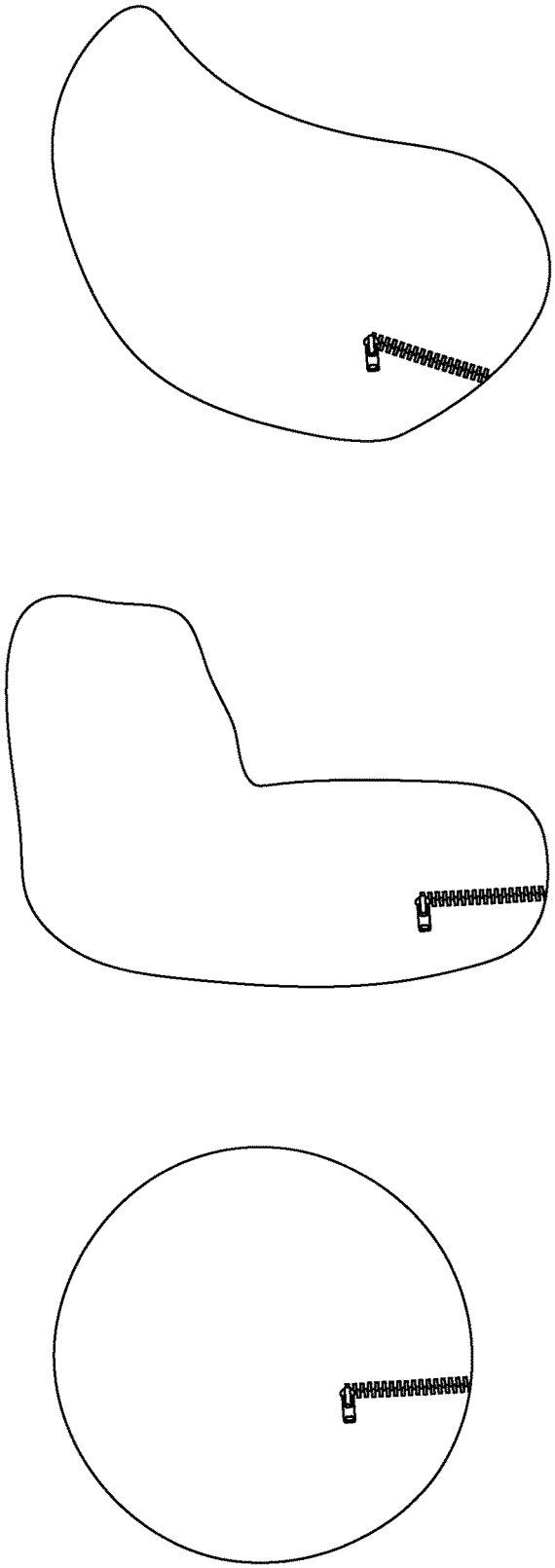
FIG. 3-FIG. 3 is a front view of three configurations of one embodiment of the present invention in its closed configuration.

Now referring to FIG. 3, several exemplary beanbag 300 shapes are illustrated and described in detail. The beanbag may be shaped into a teardrop, the classic beanbag shape, as seen in the topmost illustration in FIG. 3, into an L-shape, a chair-like shape, as seen in the central illustration in FIG. 3, and into a complete sphere as seen in the bottommost illustration in FIG. 3. In other variations, the beanbag 300 may be conformed into any desired shape by filling the beanbag 300 with an appropriate amount of equipment, physically repositioning the equipment within the beanbag 300, and physically manipulating the walls of the beanbag 300 into the desired shape.

We claim:

1. A beanbag comprising:

a flexible first layer forming a generally closed container;

cushioning lining an inside of said first layer;

a cavity within said closed container, wherein said cavity stores equipment; and at least one resealable access port embedded within a wall of said beanbag to provide a means for inserting and removing said equipment from said cavity; wherein the resealable access port comprises a tubular extension of at least the first layer, wherein the tubular extension is in a rolled configuration when the beanbag is sealed and is unrolled when the beanbag is unsealed.

2. The beanbag as in claim 1, further comprising a flexible second layer lining an inside of said cushioning.

3. The beanbag as in claim 1, further comprising a fastening mechanism attached to a base of said extension, wherein said resealable access port is sealed by pinching together a portion of said extension surrounding said resealable access port, rolling up said portion, and using said fastening mechanism to secure said beanbag in a rolled-up configuration.

4. The beanbag as in claim 1, further comprising at least one handle attached to an outside of said first layer.

5. The beanbag as in claim 1, wherein said first layer is made of marine vinyl or breathable mesh.

6. The beanbag as in claim 1, wherein said cushioning is a layer of beanbag beans.

7. The beanbag as in claim 1, wherein said cushioning is a uniform layer of marine foam, memory foam, or a foam with a density of less than 1 g/cm$^3$.

8. The beanbag as in claim 7, wherein said cushioning has a minimum uniform thickness of 0.5" and a maximum uniform thickness of 5".

9. The beanbag as in claim 1, further comprising at least one reflective band attached to an outside of said first layer and a plurality of reflective elements attached to the outside of said first layer or an outside of said reflective band, wherein said reflective band and said reflective elements highlight the life-saving nature of said beanbag.

10. A beanbag comprising:

a first layer of marine vinyl or breathable mesh forming a generally closed container;

cushioning lining an inside of said first layer, wherein said cushioning is a uniform layer of marine foam, memory foam, or a foam with a density of less than 1 g/cm$^3$, or a layer of beanbag beans;

a cavity within said closed container, wherein said cavity stores equipment; and at least one resealable access port embedded within a wall of said beanbag to provide a means for inserting and removing said equipment from said cavity; wherein the resealable access port comprises a tubular extension of at least the first layer, wherein the tubular extension is in a rolled configuration when the beanbag is sealed and is unrolled when the beanbag is unsealed.

11. The beanbag as in claim 10, further comprising a second layer of marine vinyl or breathable mesh lining an inside of said cushioning.

12. The beanbag as in claim 10, further comprising a protrusion that terminates with said resealable access port, and a fastening mechanism attached to a base of said protrusion, wherein said resealable access port is sealed by pinching together a portion of said protrusion surrounding said resealable access port, rolling up said portion, and using said fastening mechanism to secure said beanbag in a rolled-up configuration.

13. The beanbag as in claim 10, further comprising at least one handle attached to an outside of said first layer.

14. The beanbag as in claim 10, wherein said uniform layer of marine foam, memory foam, or a foam with a density of less than 1 g/cm$^3$ has a minimum uniform thickness of 0.5" and a maximum uniform thickness of 5".

15. The beanbag as in claim 10, further comprising at least one reflective band attached to an outside of said first layer and a plurality of reflective elements attached to the outside of said first layer or an outside of said reflective band, wherein said reflective band and said reflective elements highlight the life-saving nature of said beanbag.

16. A beanbag comprising:

a first layer of marine vinyl or breathable mesh forming a generally closed container;

at least one reflective band attached to an outside of said first layer and a plurality of reflective elements attached to the outside of said first layer or an outside of said reflective band, wherein said reflective band and said reflective elements highlight the life-saving nature of said beanbag;

cushioning lining an inside of said first layer, wherein said cushioning is a uniform layer of marine foam, memory foam, or a foam with a density of less than 1 g/cm$^3$ or a layer of beanbag beans; and a cavity within said closed container, wherein said cavity stores equipment;

at least one handle attached to the outside of said first layer; wherein the resealable access port comprises a tubular extension of at least the first layer, wherein the tubular extension is in a rolled configuration when the beanbag is sealed and is unrolled when the beanbag is unsealed.

17. The beanbag as in claim 16, further comprising a second layer of marine vinyl or breathable mesh lining an inside of said cushioning.

18. The beanbag as in claim 16, wherein said uniform layer of marine foam, memory foam, or a foam with a density of less than 1 g/cm$^3$ has a minimum uniform thickness of 0.5" and a maximum uniform thickness of 5".

19. The beanbag as in claim 16, further comprising a fastening mechanism attached to a base of said extension, wherein said resealable access port is sealed by pinching together a portion of said extension surrounding said resealable access port, rolling up said portion, and using said fastening mechanism to secure said beanbag in a rolled-up configuration.

* * * * *